United States Patent [19]

Lindstrom et al.

[11] Patent Number: 4,637,833

[45] Date of Patent: Jan. 20, 1987

[54] INHIBITING CORROSION: BENZYLSULFINYLACETIC ACID OR BENZYLSULFONYLACETIC ACID

[75] Inventors: Merlin R. Lindstrom; Harold W. Mark, both of Bartlesville, Okla.

[73] Assignee: Phillips Petroleum Co., Bartlesville, Okla.

[21] Appl. No.: 749,379

[22] Filed: Jun. 27, 1985

[51] Int. Cl.[4] ..... C04B 9/02; C09K 3/00

[52] U.S. Cl. ..... 106/14.13; 106/14.27; 252/359; 252/8.555 422/12

[58] Field of Search ..... 106/14.13, 14.27; 252/8.55 E, 395; 422/12

[56] References Cited

U.S. PATENT DOCUMENTS

| | | | |
|---|---|---|---|
| 2,426,496 | 8/1947 | Farley | 252/395 |
| 2,966,458 | 12/1960 | Counts | 252/8.55 E |
| 3,466,188 | 9/1969 | Annand et al. | 428/461 |
| 3,591,354 | 7/1971 | Bouffard | 44/76 |
| 4,495,336 | 1/1985 | Hausler | 252/8.55 E |

*Primary Examiner*—A. Lionel Clingman

*Attorney, Agent, or Firm*—A. W. Umphlett

[57] ABSTRACT

Hydrocarbyl-substituted sulfinyl and sulfonyl carboxylic acids are effective corrosion inhibitors for surfaces of various metals. In one embodiment, mineral acid compositions such as aqueous hydrochloric acid metal cleaning solutions exhibit diminished corrosiveness when corrosion inhibiting additives of the invention are present in the compositions.

12 Claims, No Drawings

INHIBITING CORROSION: BENZYLSULFINYLACETIC ACID OR BENZYLSULFONYLACETIC ACID

BACKGROUND OF THE INVENTION

This invention relates to the treatment of metal surfaces to increase resistance to corrosion. In another aspect this invention relates to compositions which form a corrosion resistant film on metal surfaces to which the compositions are applied. This invention further relates to the inhibition of corrosion caused by compositions comprising acidic liquids in contact with metal during acidic processing, e.g. pickling. More particularly, the invention relates to inhibiting such corrosion by adding to the composition an additive which will impart the desired properties thereto.

The problem of corrosion of metal surfaces in contact with various corrosive materials is well known. Most acidic liquids or compositions comprising same will cause corrosion when in contact with metals. The extent of such corrosion will, of course, depend to a large extent on the system on or in which the acidic material is to be used or upon the environmental conditions of such use. For example, corrosion of metal pipes, pumps and other equipment is a serious problem requiring monitoring of metal surfaces in drilling equipment used in oil well recovery operations. The down well metal surfaces are in contact with large quantities of corrosive materials and extreme conditions of temperature and pressure act to accelerate corrosion and intensify the problems of maintaining chemical protection for the equipment.

Conventional corrosion inhibiting agents are often not effective at all under extreme conditions or reduce corrosion for only a short period of time and then must be reapplied often at great expense and inconvenience, especially if the well site is not easily accessible or poses difficulties of transporting and applying large volumes of chemicals.

Metal surfaces can be cleaned by solvent, solvent emulsion, alkaline cleaners, solvent vapor degreasing, or abrasive blasting. Conventional cleaners will not remove scale and oxides from metals. Thus, it is necessary sometimes to use an acid treatment (pickling) to remove rust and other corrosion products. However, acids generally used are corrosive and, therefore, there is a need to inhibit such corrosion.

The invention relates to methods and materials suitable for inhibiting corrosion of a material subject thereto and particularly concerning the inhibition of corrosion of metals such as porous metals including aluminum, copper, brass, solder, and the like.

Accordingly, an object of this invention is to provide compositions which can be applied to metal surfaces to inhibit corrosion and pitting of the metal.

Another object of the invention is to provide a method of treating metal surfaces so as to form a film which inhibits corrosion on the metal even under extreme conditions of temperature and pressure and in highly corrosive environments.

Another object of this invention is to provide inhibitors effective for decreasing corrosion due to acidic materials.

Other objects, aspects, as well as the several advantages of the invention will be apparent to those skilled in the art upon reading the specification and the appended claims.

SUMMARY OF THE INVENTION

According to the invention, it has been discovered that hydrocarbyl-substituted sulfinyl and sulfonyl carboxylic acids exhibit good corrosion inhibition.

In accordance with one embodiment of the invention there is provided compositions comprising aqueous acidic fluids and a corrosion inhibiting amount of at least one of hydrocarbyl-substituted sulfinyl and sulfonyl carboxylic acids.

Therefore, in one embodiment of the present invention there is provided novel corrosion inhibiting compositions useful for treating metal surfaces. In another embodiment of this invention there is further provided methods of treating metal surfaces with compositions that will inhibit corrosion or provide a corrosion inhibiting film on metal surfaces.

The compositions of the invention can be applied by contacting a metal surface with the compositions so that a film is formed thereon. The compositions can be applied as a solution of one corrosion inhibitor or by contacting the metal with a solution containing one or more of hydrocarbyl-substituted sulfinyl and sulfonyl carboxylic acids.

DESCRIPTION OF THE INVENTION

The invention corrosion inhibiting compositions comprise at least one of hydrocarbyl-substituted sulfinyl and sulfonyl carboxylic acids. In one embodiment of the invention the hydrocarbyl-substituted sulfinyl and sulfonyl carboxylic acid is part of a composition comprising an aqueous acidic composition containing a mineral acid, for example, HCl, or a phosphoric acid or other acid pickle.

Hydrocarbyl-substituted sulfinyl and sulfonyl carboxylic acids that can be used in the practice of the invention include acids represented by the formula $$R—S(O)_x—R'—COOH$$

wherein R is a hydrocarbyl group selected from alkyl, cycloalkyl, aralkyl and aryl having from 5 to about 10 carbon atoms, R' is an alkylene containing from 1 to about 3 carbon atoms, and X is 1 or 2.

Examples of suitable hydrocarbyl-substituted sulfinyl carboxylic acids include, among others, the following:

benzylsulfinylacetic acid
benzylsulfinylpropionic acid
benzylsulfinylbutyric acid
pentylsulfinylacetic acid
cyclohexylsulfinylacetic acid
phenylsulfinylpropionic acid
6,6-dimethylheptylsulfinylpropionic acid
iso-propylbenzylsulfinylbutyric acid
and the like, and mixtures thereof.

Examples of suitable hydrocarbyl-substituted sulfonyl carboxylic acids include, among others, the following:

benzylsulfonylacetic acid
benzylsulfonylpropionic acid
benzylsulfonylbutyric acid
pentylsulfonylacetic acid
cyclohexylsulfonylacetic acid
phenylsulfonylpropionic acid
6,6-dimethylheptylsulfonylpropionic acid
iso-propylbenzylsulfonylbutyric acid and the like, and mixtures thereof.

The hydrocarbyl-substituted sulfinyl and sulfonyl carboxylic acids of the invention are known compounds in the art and can be prepared by methods known in the art.

The corrosion inhibiting agents of the invention can be applied directly to metal surfaces to provide a corrosion inhibiting film thereon or can be applied to metal surfaces as part of an acidic or other composition. Typical acidic compositions include aqueous mineral acids such as HCl, $H_2SO_4$, phosphoric, etc. The concentration of acid present in the aqueous compositions can vary appreciably and ordinarily will range from about 0.1 weight percent to about 30 weight percent.

The amount of corrosion inhibiting agent present in an aqueous acidic composition can vary appreciably depending upon the acidic system and metal being protected, but all that is required is a corrosion improving or corrosion inhibiting amount of at least one of the instant carboxylic acids. However, the corrosion inhibiting amount will ordinarily range from about 0.01 to about 5 weight percent, preferably about 0.1–1 weight percent for practical reasons.

The invention compositions are useful for coating oxidizable metal surfaces, particularly surfaces of objects made from iron and steel. It is particularly useful for treating metal surfaces such as metal pipes and casings in oil, gas and geothermal wells, which are subjected to high temperatures and pressure and corrosive chemical agents and for treating pipelines which carry fluids containing water.

In some treatment methods it is advantageous to employ a carrier liquid or drive fluid to force a slug of the corrosion-inhibiting composition down into the well being treated. Suitable diluents that can be used include hydrocarbons, such as isomeric xylenes, toluene, benzene, naphtha, fuel oil, diesel oil, heavy aromatic oils, Stoddard solvent, and crude oil. In view of practical and economic reasons, diesel oil, sea water or condensate from the well being treated are preferred carrier fluids. An inert gas, such as nitrogen, can be used as a drive fluid.

Down-hole treatments with the corrosion-inhibiting compositions can be effected by a variety of methods, depending upon the particular chemical and physical characteristics of the well being treated. The following down-hole treatment methods can be used to apply the composition to metal surfaces of equipment used to recover natural fluids from a subterranean reservoir.

Batch Treatment

The invention composition and hydrocarbon diluent is introduced preferably in an oil carrier into the annulus of a cased wellbore between the casing and the tubing. The well is returned to production and the injectied compositions are gradually returned with the produced fluids, effecting en route the coating of contacted metal surfaces with a corrosion-resistant film. Alternatively in this method, a liquid column of the treating agent can be placed in the tubing or the annular space and allowed to stand for a time which can range from 10 minutes to 24 hours before resuming production, usually at least 1 hour.

Extended Batch Treatment

The invention composition is injected into the annular space of a cased wellbore, the well is closed off, and the composition is continously circulated with well fluids down the annulus and up the tubing for an extended period of time which can vary widely but will usually be between 2 and 48 hours. At the end of the determined time period, the well is returned to production.

Squeeze Treatment

The invention composition is injected down a cased wellbore penetrating a subterranean formation and is forced into the formation against formation pressure with high-pressure pumps. The composition can be injected within a gelled or dispersed polymer matrix based, for example, on polyacrylamides, biopolysaccharides, or cellulose ethers. After the pressure is released, the treating agent is slowly produced back with the recovered fluids, resulting in the application of a corrosion-resistant film on metal surfaces contacted by the treating agent as it flows to the surface. This method is particularly suitable in high-pressure gas or oil wells.

Spearhead Treatment

A highly concentrated slug of the invention composition is injected into the tubing of a cased borehole and pressured down the tubing with nitrogen or a fluid column of a brine solution such as 2 weight percent aqueous potassium chloride. When the pressure is released, the aqueous brine column or nitrogen and the corrosion-inhibiting composition are produced up the tubing. The composition as a concentrated slug thus contacts the metal walls of the tubing and lays down a protective film as it flows in a downward and upward circuit.

Metal surfaces can also be protected by dipping or spraying the surfaces with the invention compositions and then allowing excess fluid to drain from the treated surfaces at ambient conditions. A protective film is thus formed on the metal surface without conventional heat-curing or extended air-drying treatment, although such drying treatments can be used if desired and if conditions permit it. The advantage in using an anti-corrosion system which does not require air- or heat-drying is that the system can be applied to metal surfaces which are hundreds or thousands of feet below ground level or in an environment which is always flooded with brine or other fluids.

When applying the composition to the metal tubing of, for example, a gas or oil well, it is not necessary to pre-coat the treated metal surfaces with oil or other substances prior to applying the invention composition, and the treated surfaces may or may not have an oil coating prior to the application. It is contemplated that the invention composition will provide effective corrosion inhibition in wells producing as much as 95 percent brine and 5 percent oil.

The following example illustrates the present invention.

EXAMPLE I

A series of runs were carried out in which precleaned carbon steel coupons were immersed for a period of about 3 hours at 200° F. in 10 weight percent HCl.

The coupons were vapor degreased with chloroform, scrubbed with an abrasive household cleaner, rinsed with distilled water and then acetone. Each coupon was dried in a desiccator overnight and then weighed. Glass bottles containing 200 ml 10 weight percent HCl and 0.6 ml inhibitor were immersed for 30 minutes in 200° F.

constant temperature bath. Then the coupons were suspended in the hot acid for three hours. The coupons were rinsed with water, scrubbed with an abrasive cleaner, rinsed with distilled water and then acetone. After remaining in a desiccator overnight, each coupon was reweighed.

In two of the runs the HCl did not contain a corrosion inhibitor, and in the remaining runs the HCl contained 0.3 weight percent of inventive corrosion inhibitors or closely related control corrosion inhibitors.

The results of these tests are set forth in the following table:

TABLE I

| Coupon | Additive | Weight Loss (g) | Corrosion Rate lb/ft$^2$/day | Average Inhibition* |
|---|---|---|---|---|
| 1 | None | 6.4111 | 8.56 | — |
| 2 | None | 6.4110 | 8.44 | — |
| 3 | Benzylsulfinyl-acetic Acid | 0.3932 | 0.52 | 94.24% |
| 4 | Benzylsulfinyl-acetic acid | 0.3523 | 0.46 | |
| 5 | Benzylsulfinyl-acetic acid | 0.3360 | 0.44 | 94.15% |
| 6 | Benzylsulfinyl-acetic acid | 0.3475 | 0.46 | |
| 7 | Benzylsulfonyl-acetic acid | 0.7513 | 1.11 | 86.9% |
| 8 | Benzylsulfonyl-acetic acid | 0.6614 | 0.97 | |
| 9 | n-Butylsulfi-nylacetic acid | 4.6569 | 6.87 | 14.4% |
| 10 | n-Butylsulfi-nylacetic acid | 4.5153 | 6.68 | |
| 11 | Benzylthio-acetic acid | 4.7886 | 6.35 | 18.8% |
| 12 | Benzylthio-acetic acid | 4.6641 | 6.14 | |

*Average of each pair of tests.

The data for the n-butyl derivative (coupons 9 and 10) indicate that the hydrophobic portion of the substituted sulfinyl carboxylic acid molecule should contain more than four carbon atoms. The related thio-sulfur derivative (coupons 11 and 12) of the benzyl-substituted sulfinyl or sulfonyl acetic acids is a significantly less effective corrosion inhibitor than the inventive compounds.

Referring to invention runs 3–8, it is evident that benzylsulfinylacetic acid and benzylsulfonylacetic acid are effective corrosion inhibitors in an HCl system. Control runs 1 and 2 demonstrate the corrosion rate of an HCl system containing no corrosion inhibitor additive.

That which is claimed is:

1. A method of inhibiting the corrosiveness of acidic systems which comprises incorporating into the system a corrosion inhibiting amount of at least one of benzylsulfinylacetic acid and benzylsulfonylacetic acid.

2. A method according to claim 1 wherein the acid system contains a mineral acid.

3. A method according to claim 1 wherein the acidic system contains HCl.

4. A method according to claim 1 wherein the corrosion inhibiting additive contains a maximum of about 14 carbon atoms and is present in the system in an amount ranging from about 0.01 to about 5 weight percent.

5. A method for treating metal surfaces to inhibit corrosion thereof comprising contacting a metal surface with at least one of benzylsulfinylacetic acid and benzylsulfonylacetic acid in an amount sufficient to inhibit the formation of corrosion.

6. A method according to claim 5 in which the metal surface includes drilling equipment in a well for the recovery of natural fluids from subterranean formations.

7. A method according to claim 6 wherein the composition is forced down the well using a drive fluid.

8. A corrosion inhibiting aqueous composition comprising (a) mineral acid, and (b) at least one of benzylsulfinylacetic acid or benzylsulfonylacetic acid.

9. A composition according to claim 8 wherein (a) is HCl.

10. A composition according to claim 8 wherein (b) is benzylsulfinylacetic acid.

11. A composition according to claim 8 wherein (b) is present in an amount ranging from about 0.01 to about 5 weight percent.

12. A composition according to claim 8 wherein (b) is benzylsulfonylacetic acid.

* * * * *